US006189167B1

(12) United States Patent
Tsai

(10) Patent No.: US 6,189,167 B1
(45) Date of Patent: Feb. 20, 2001

(54) PILLOW

(76) Inventor: Chi-Wen Tsai, No.486 Chung-Cheng Road, Shu-Lin Town, Taipei Hsien (TW)

( * ) Notice: Under 35 U.S.C. 154(b), the term of this patent shall be extended for 0 days.

(21) Appl. No.: 09/289,636

(22) Filed: Apr. 12, 1999

(51) Int. Cl.[7] ..... A47C 20/00
(52) U.S. Cl. ..... 5/636; 5/640; 5/915
(58) Field of Search ..... 5/636, 624, 648, 5/108, 109, 630, 632, 643, 640, 933, 915, 657

(56) References Cited

U.S. PATENT DOCUMENTS

| | | | |
|---|---|---|---|
| 2,902,993 | 9/1959 | Wagner | 5/915 X |
| 4,941,478 | 11/1994 | Takeuchi et al. | 5/640 X |
| 5,361,437 | 11/1994 | Zhu et al. | 5/640 X |
| 5,626,555 | 5/1997 | Di Blasi et al. | 5/933 X |
| 5,735,575 | 4/1998 | Harza | 5/109 X |

*Primary Examiner*—Terry Lee Melius
*Assistant Examiner*—James M Hewitt
(74) *Attorney, Agent, or Firm*—Dougherty & Troxell

(57) ABSTRACT

A pillow includes a lower housing for containing a base, a motor connected to a transmitting device, and an upper housing. The motor rotates the transmitting device, which has several transmitting shafts and gears so as to provide different modes of movement, such as rotation and up and down movement, to the pillow. The upper housing is fixed with the transmitting device, supporting the body of a user, and having a curved recess formed in an upper surface to suit to the curvature of a human body. A cover covers the upper and lower housings to prevent miscellaneous matters from entering the interior of the upper and the lower housings.

5 Claims, 8 Drawing Sheets

PILLOW

BACKGROUND OF THE INVENTION

This invention relates to a pillow, particularly to one structured to suit old, feeble or bed-ridden persons for increased comfort and fun.

Common conventional pillows, which only rotate on a spot, are structured in such a way that a user has to use force for rotating a pillow. Senior persons may not be able to handle this kind of interesting product, for a couple to get pleasure out of using it.

SUMMARY OF THE INVENTION

The purpose of the invention is to offer a pillow, which can be used by old, feeble or bed-ridden persons for comfort and fun.

The main feature of the invention is a transmitting device for rotating and moving the pillow up and down at the same time.

BRIEF DESCRIPTION OF THE DRAWINGS

This invention will be better understood by referring to the accompanying drawings, wherein.

DETAILED DESCRIPTION OF PREFERRED EMBODIMENTS

Figure 1:
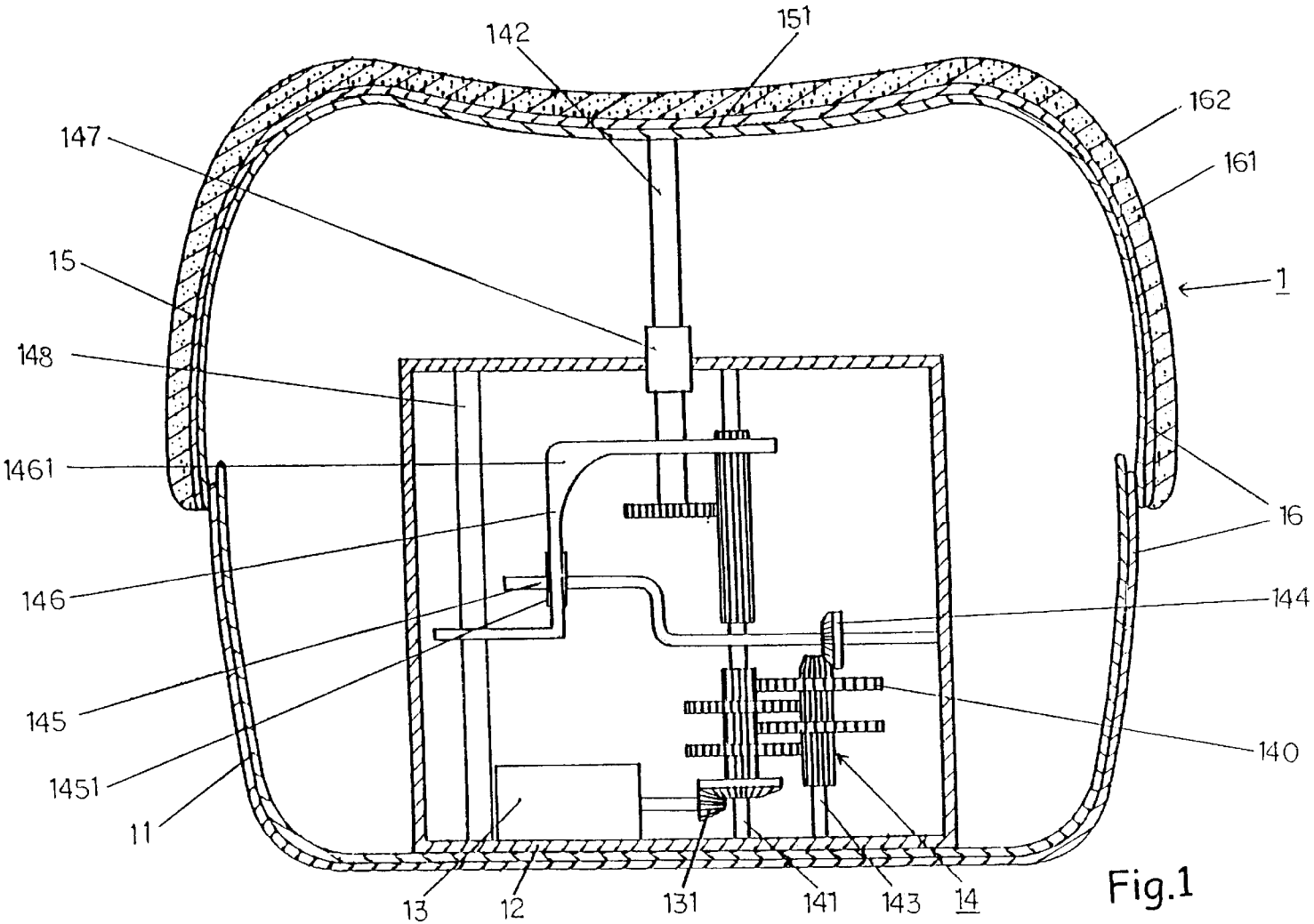
FIG. 1 is a cross-sectional view of a first embodiment of a pillow according to the present invention.
Figure 2:
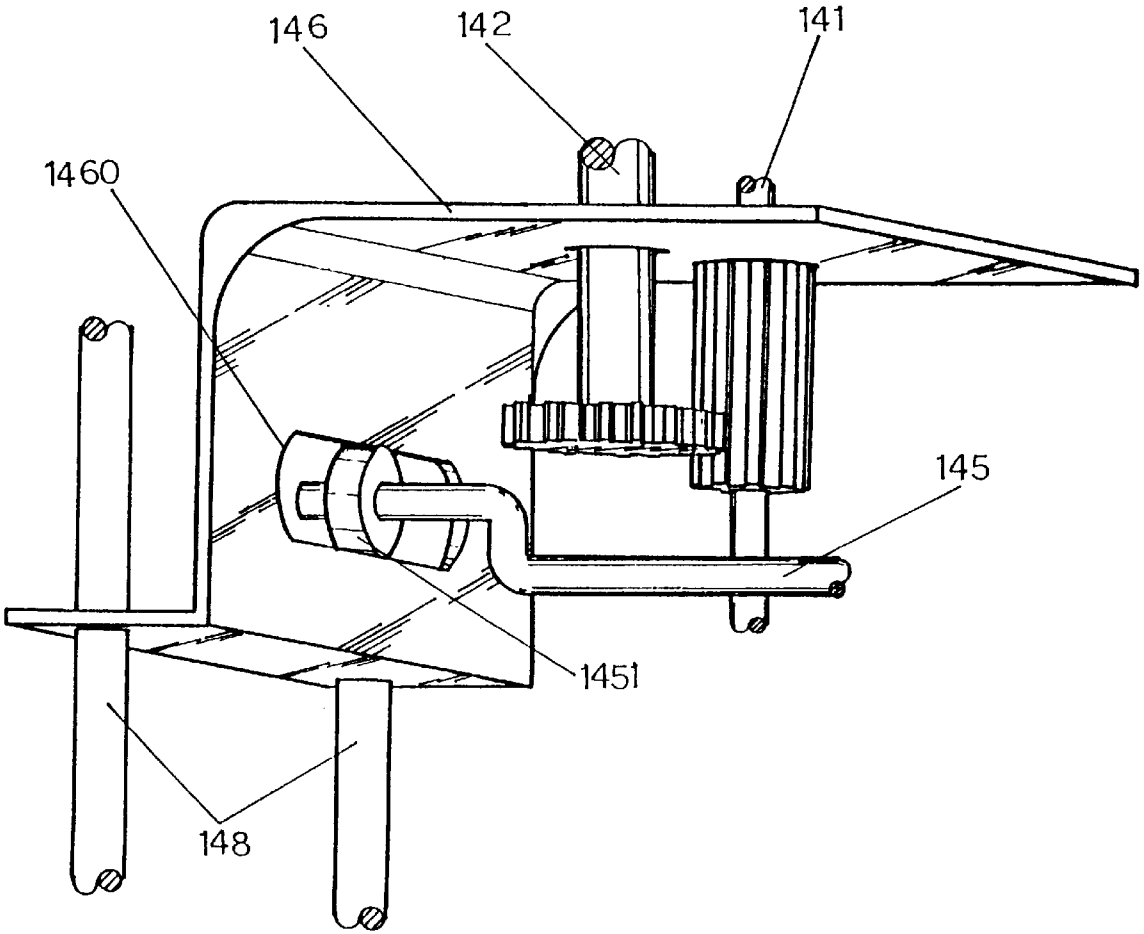
FIG. 2 is a partial perspective view of the mechanism of the first embodiment of a pillow according to the present invention.
Figure 3:
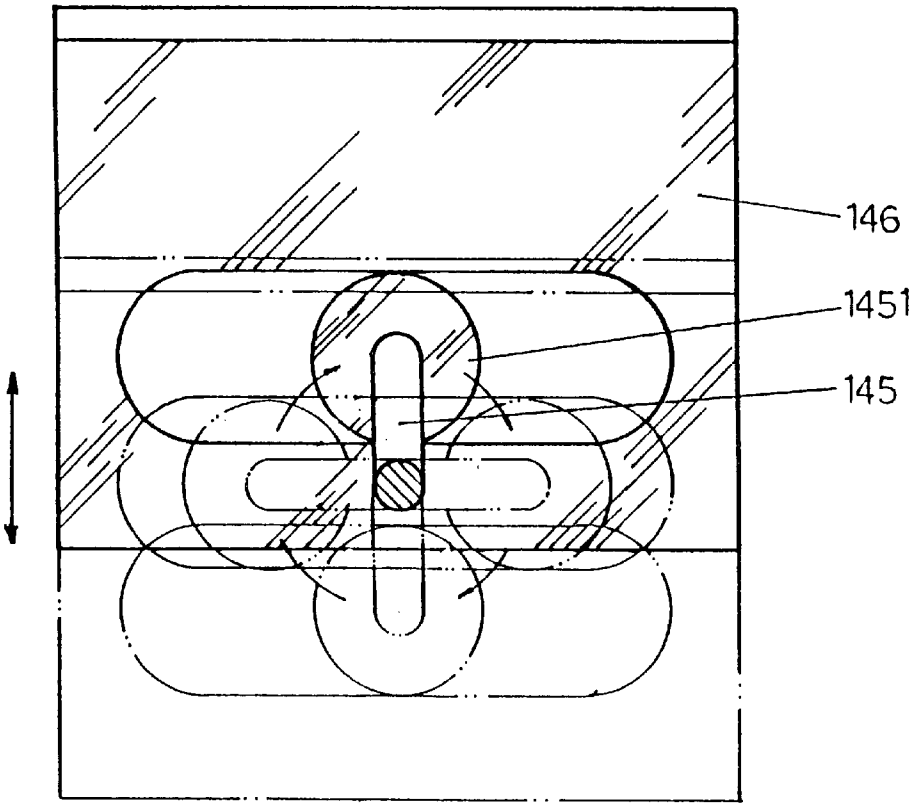
FIG. 3 is a partial side view of a movable plate use in the first embodiment of a pillow according to the present invention.

A first embodiment of a pillow 1 in the present invention, as shown in FIGS. 1, 2, 3 and 4, includes a lower housing 11, a base 12, a motor 13, a transmitting device 14, an upper housing 15, and a cover 16, as main components.

The lower housing 11 has a hollow space for containing the other components.

The base 12 is fixed on the bottom of the lower housing 11.

The motor 13 is fixed on the base 12, functioning to drive the transmitting device 14.

The transmitting device 14 consists of a plurality of shafts and gear sets, driven by the motor 13 to rotate and move the pillow 1 up and down.

The upper housing 15 is positioned on the lower housing 11 and combined tightly with the transmitting device 14. To support the body of a user, the upper housing has a curved recess 151 conforming to the curvature of a human body formed on its upper surface for the hip of a user to rest on.

The cover 16 covers the upper and the lower housings 15 and 11, preventing miscellaneous matters from falling into the interiors of the housings 15 and 11.

The main power source of the invention is the motor 13 to which a bevel gear 131 is fixed on the shaft of the motor 13 for rotating two pairs of gears of the transmitting device 14, which has two outputs.

The transmitting device 14 includes a main shaft 141 engaging a transmitting rod 142 by means of gears. The transmitting rod 142 is fitted through a cylindrical bearing 147 fixed in an upper wall of the base 12. Then the transmitting rod 142 can rotate the upper housing 15 fixed to an upper end of the rod 142 when the rod 142 is rotated by the shaft 141. The transmitting rod 142 is rotatably mounted in the bearing 147, so as to rotate and move up and down at the same time.

The main transmitting shaft 141 also is engaged with an auxiliary shaft 143 by means of gears. A pair of bevel gears 144 are respectively fixed on the auxiliary shaft 143 and a crankshaft 145. Further, a roller wheel 1451 is fixed adjacent an end of the crankshaft 145, which is located in a slide groove 1460 of the movable plate 146. The movable plate 146 can be moved up and down by the crankshaft 145. The movable plate 146 has an end portion fitted around the main shaft 141 and its opposite end portion fitted around position rods 148 so that the movable plate 146 can move up and down.

Figure 4:
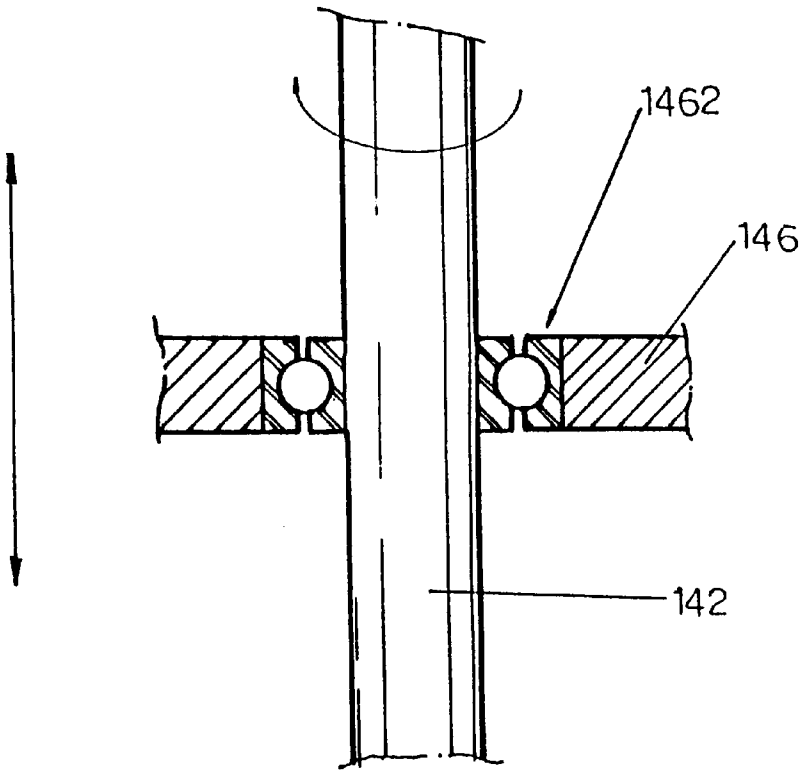
FIG. 4 is a partial side view of a transmitting rod used in the present invention.

As shown in FIG. 4, the transmitting rod 142 passes through and is fixed to the movable plate 146 by means of a joint bearing 1462 so that the movable plate 146 may move up and down with the transmitting rod 142 and the upper housing 15 as well, without affecting the rotation of the transmitting rod 142.

In order to support the weight of a human body, the cylindrical bearing 147 is fixed to the base 12 to disperse and buffer the body weight so that the body weight does not completely press on the transmitting rod 142.

The movable plate 146 is L-shaped having a support member 1461 integrally formed or fixed at the intermediate corner performing a reinforcing function to prevent the movable plate 146 from disfiguring in use.

Thus, the upper housing 15 can be rotated and moved up and down at the same time by means of movement of the transmitting rod 142 and the movable plate 146, functioning to give some pleasure to a couple's life.

In addition, for convenience of use, a battery case may be added in the lower housing 11 as a power source, and a transformer added so that different voltage may be used, for example 110 V/220 V. Besides, a switch for changing speed may be connected to the motor 13 for a user to change speed of the motor 13 to suit the different needs of the user.

The cover 16 is provided to cover the upper housing 15 and the lower housing 11 to prevent miscellaneous matters from entering the housing during use and preventing the upper housing 15 from becoming stuck with the lower housing 11.

Further, a foam layer 161 and a decorative cloth 162 on the foam layer 161 may be added on the cover 16 to supply elasticity to the cover 16 so that a user may lie thereon comfortably.

Figure 5:
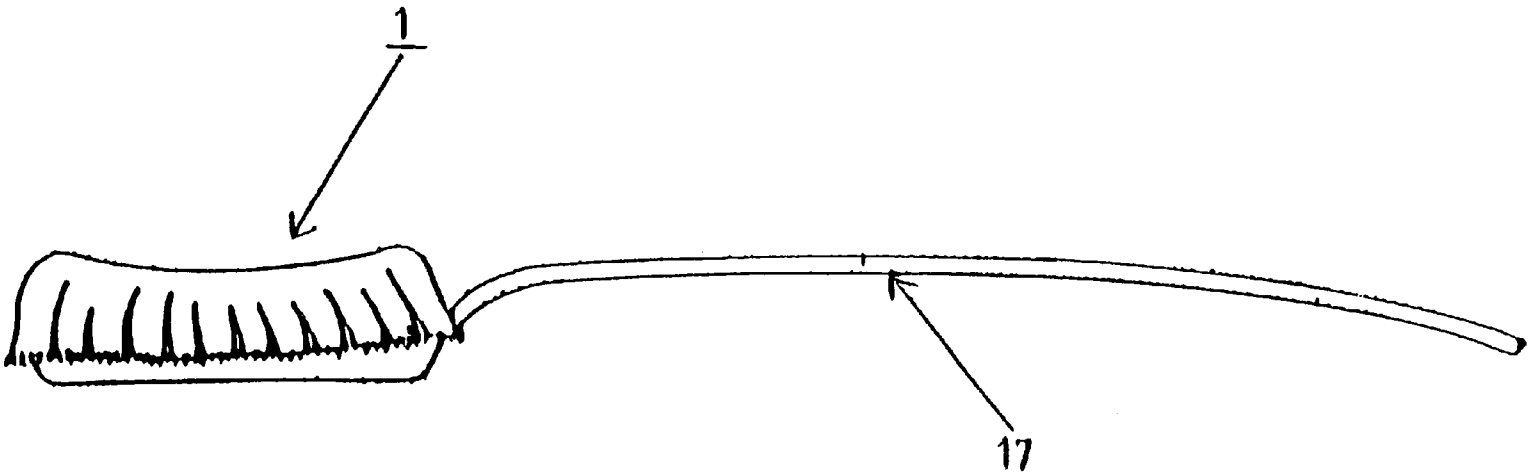
FIG. 5 is a side view of the first embodiment of a pillow according to the present invention.

As shown in FIG. 5, a waist plate 17 is additionally provided to extend from a side of the lower housing 11, having such a curvature as a human body for comfortably supporting the waist portion of a user.

Figure 6:
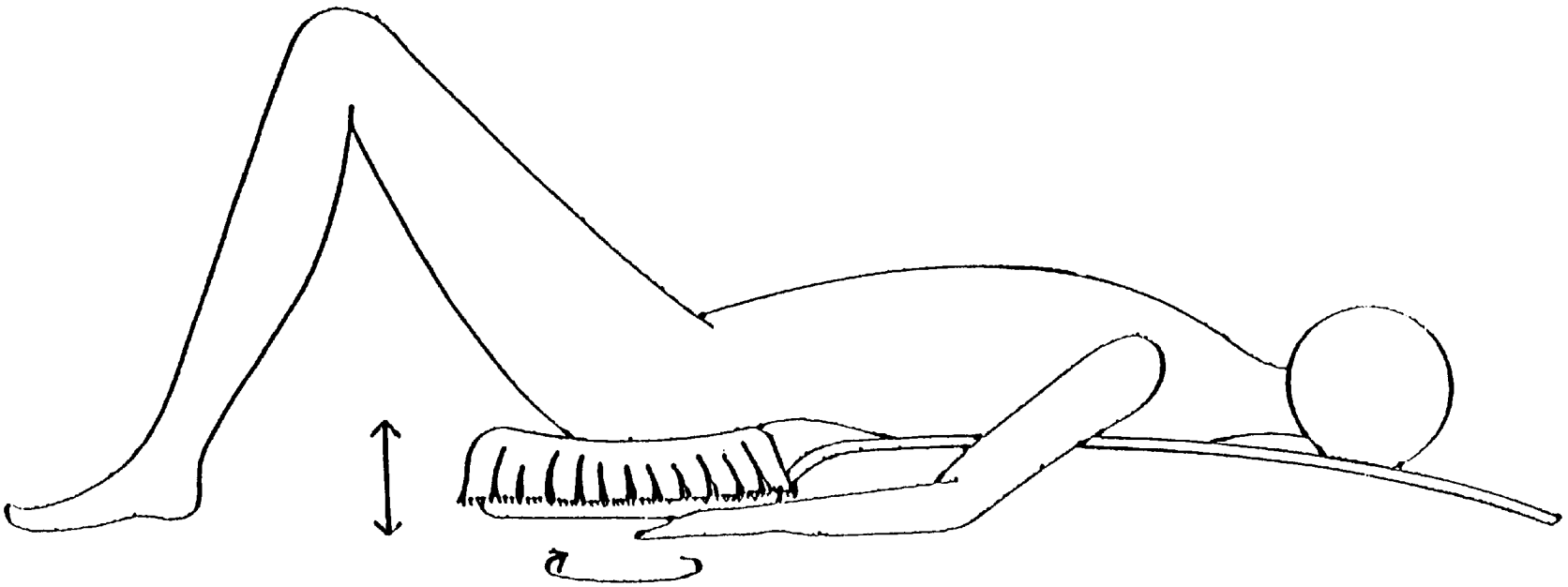
FIG. 6 is a side view of the pillow of the present invention being used.

In using the pillow, as shown in FIG. 6, a user can sit on the curved recess 151 of the upper housing 15, and then lie on the waist plate 17 with his/her back. Then a switch is turned on to let the upper housing 15 rotate and move up and down as shown by the arrows in FIG. 6 so that the hips of the user may move up and down, and be massaged at the same time by the rotating upper housing 15.

Figure 7:
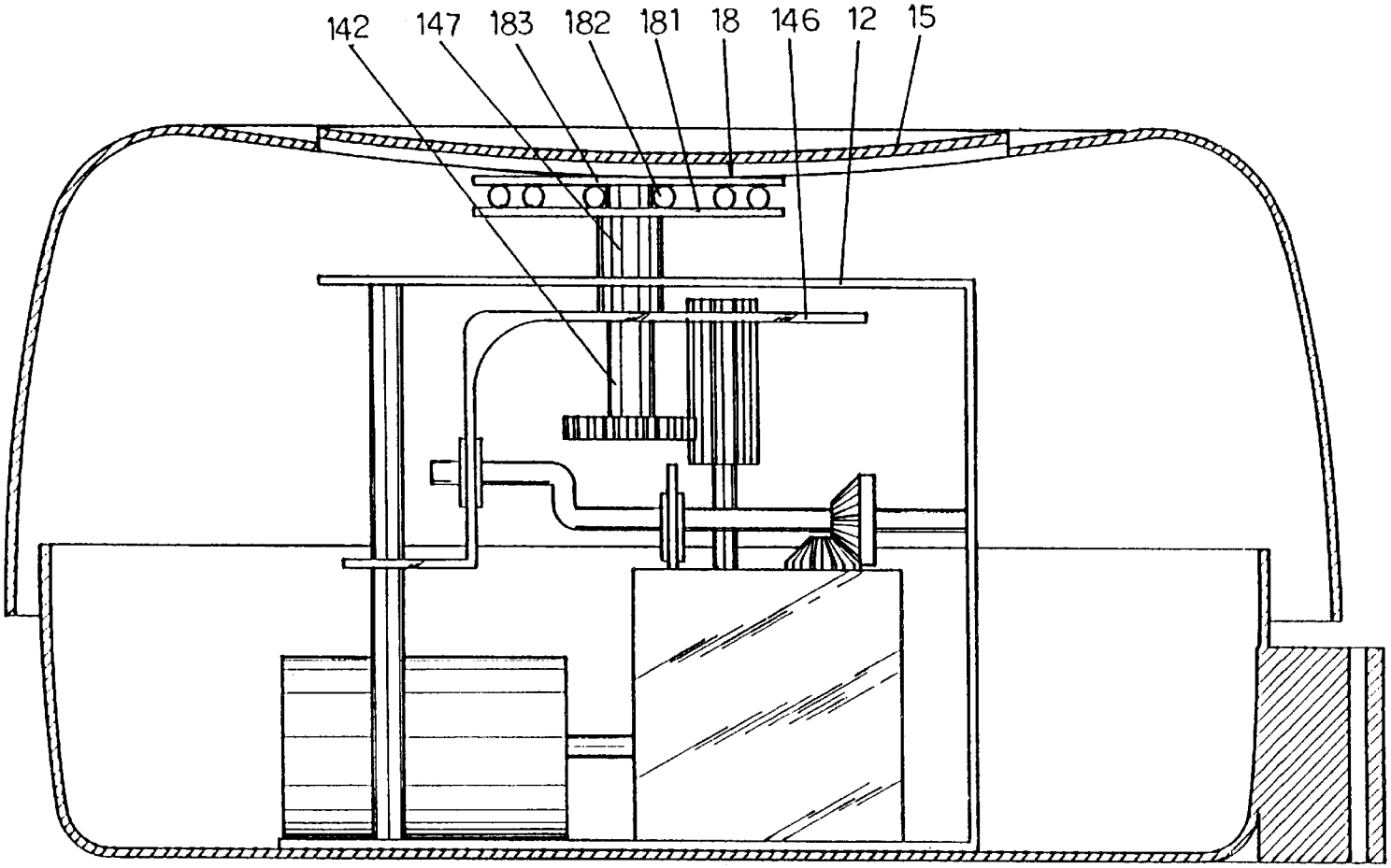
FIG. 7 is a cross-sectional view of a second embodiment of a pillow according to the present invention; and, FIG. 8 is a partial side cross-section of the second embodiment of a pillow in the present invention, showing it in a sloped condition.
Figure 8:
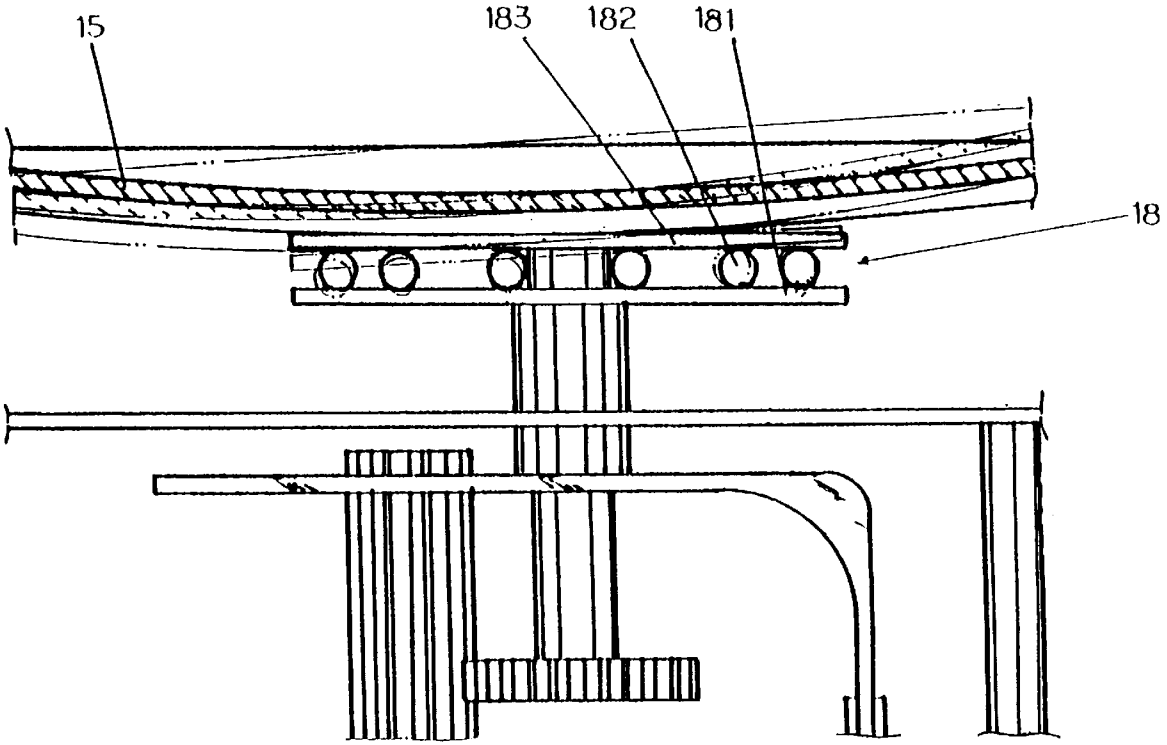

Further, as shown in FIGS. 7 and 8, a second embodiment of the pillow in the invention has the upper housing 15 and the transmitting rod 142 connected with a universal joint, and a disc bearing 18 for inclining movement. The disc bearing 18 has a lower disc 181 fixed on the transmitting rod 142, an upper disc 183 fixed with the upper housing 15, and a plurality of steel balls 182 sandwiched between the upper and the lower disc 183 and 181. When the transmitting rod 142 rotates the upper and the lower discs 183 and 181, the steel balls 182 rotate along sloped grooves formed in the upper and the lower discs 183 and 181 so that the upper housing may be inclined in any direction, permitting the user to feel comfortable. In addition, the upper housing 156 is connected to the transmitting rod 142 by means of the universal joint, enabling the upper housing 15 to rotate in spite of its inclining movement.

While the preferred embodiment of the invention has been described above, it will be recognized and understood that various modifications may be made therein and the appended claims are intended to cover all such modifications which may fall within the spirit and scope of the invention.

What is claimed is:

1. A pillow comprising:

a) a lower housing;

b) a base mounted within the lower housing;

c) a drive mechanism mounted on the base and comprising:

i) a motor having an output shaft;

ii) a main shaft rotatably mounted in the base and rotated by the rotation of the output shaft of the motor;

iii) an auxiliary shaft located adjacent to and rotated by the main shaft;

iv) a transmitting rod rotatably and movably mounted on the base so as to be movable relative to the base along a longitudinal axis of the transmitting rod, the transmitting rod engaged with the main shaft such that rotation of the main shaft causes rotation of the transmitting rod;

v) a crankshaft engaging the auxiliary shaft such that rotation of the second shaft causes rotation of the crankshaft; and, vi) a plate movably mounted on the base and connected to the crankshaft and the transmitting rod such that rotation of the crankshaft causes reciprocating movement of the plate and reciprocating movement of the transmitting rod along the longitudinal axis thereof;

d) an upper housing mounted on the transmitting rod so as to rotate and reciprocate therewith, the upper housing having a curved recess to accommodate a hip of a user; and, e) a cover covering the upper and lower housings.

2. The pillow of claim 1 further comprising a waist supporting plate extending from the lower housing for supporting a waist portion of a user.

3. The pillow of claim 1 wherein the plate has an L-shaped configuration.

4. The pillow of claim 1 wherein the cover further comprises layers of foam material and cloth material.

5. The pillow of claim 1 further comprising a universal joint mounting the upper housing on the transmitting rod, the universal joint including:

a) a lower disc affixed to the transmitting rod;

b) an upper disc affixed to the upper housing; and c) a plurality of steel balls located between and in contact with the upper and lower discs.

* * * * *